US008016642B2

(12) United States Patent
Kuroiwa et al.

(10) Patent No.: US 8,016,642 B2
(45) Date of Patent: Sep. 13, 2011

(54) BLASTING DEVICE FOR STEEL PIPE INNER SURFACE, BLASTING METHOD FOR STEEL PIPE INNER SURFACE, AND METHOD FOR PRODUCING STEEL PIPE WITH EXCELLENT INNER SURFACE TEXTURE

(75) Inventors: Yoshiyuki Kuroiwa, Arida (JP); Akihiro Sakamoto, Chiba (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 3 days.

(21) Appl. No.: 12/379,725

(22) Filed: Feb. 27, 2009

(65) Prior Publication Data

US 2009/0233531 A1 Sep. 17, 2009

Related U.S. Application Data

(63) Continuation of application No. PCT/JP2007/064735, filed on Jul. 27, 2007.

(30) Foreign Application Priority Data

Sep. 1, 2006 (JP) ..... 2006-237467

(51) Int. Cl.
*B24B 1/00* (2006.01)

(52) U.S. Cl. ..... 451/38; 451/76

(58) Field of Classification Search ..... 451/38, 451/76

See application file for complete search history.

(56) References Cited

U.S. PATENT DOCUMENTS 5,239,786 A * 8/1993 Carpenter ..... 451/38
6,159,311 A * 12/2000 Amaya et al. ..... 148/325

FOREIGN PATENT DOCUMENTS

| | | |
|---|---|---|
| JP | 49-017502 | 5/1974 |
| JP | 52-49678 | 12/1977 |
| JP | 56-16029 | 4/1981 |
| JP | 60-6354 | 1/1985 |
| JP | 60-263671 | 12/1985 |
| JP | 5-228842 | 9/1993 |
| JP | 8-90418 | 4/1996 |
| JP | 11-58241 | 3/1999 |
| JP | 11-236651 | 8/1999 |
| JP | 11-320413 | 11/1999 |

OTHER PUBLICATIONS

Enlish language machine translation of JP 60263671.*

* cited by examiner

*Primary Examiner* — Maurina Rachuba
(74) *Attorney, Agent, or Firm* — Clark & Brody

(57) ABSTRACT

A blasting device for blasting steel pipe inner surface includes a tubular carrier fluid inflow unit connected to one end of a horizontal steel pipe, and a negative pressure suction unit connected to the other end of the steel pipe. A polishing material or a wiping material is injected horizontally into the carrier fluid inflow unit along with a carrier fluid from a hole formed in the edge face of the tubular carrier inflow unit. The device provides improved blast performance as well as the capability to blast the inner surface from beginning portion to an end portion to provide an excellent inner surface texture.

11 Claims, 12 Drawing Sheets

[Figure 1] (Prior Art)
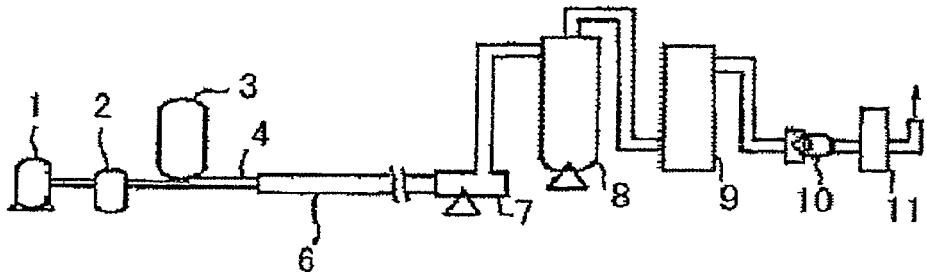
[Figure 2] (Prior Art)
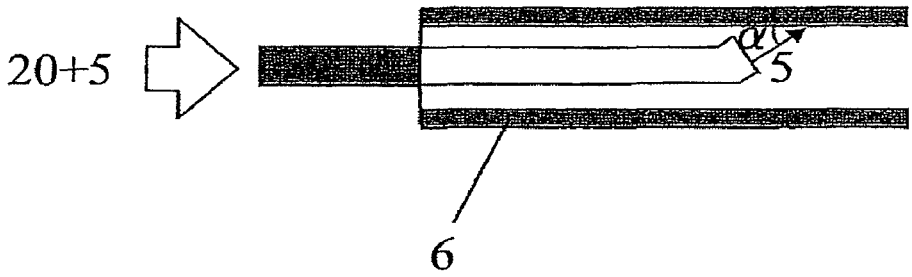

[Figure 3] (Prior Art)
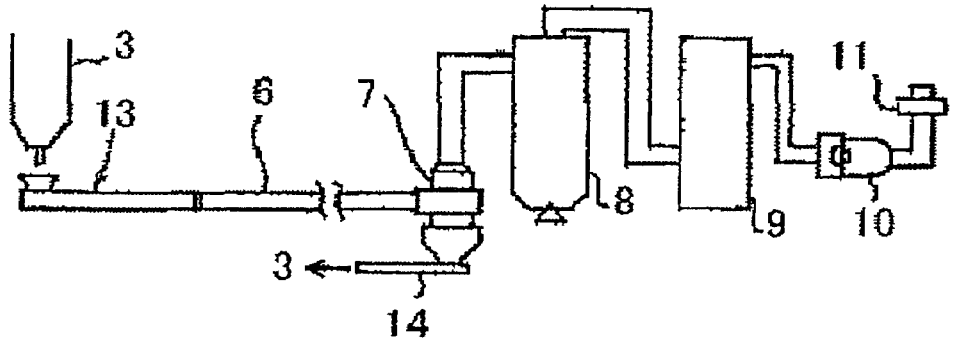
[Figure 4] (Prior Art)
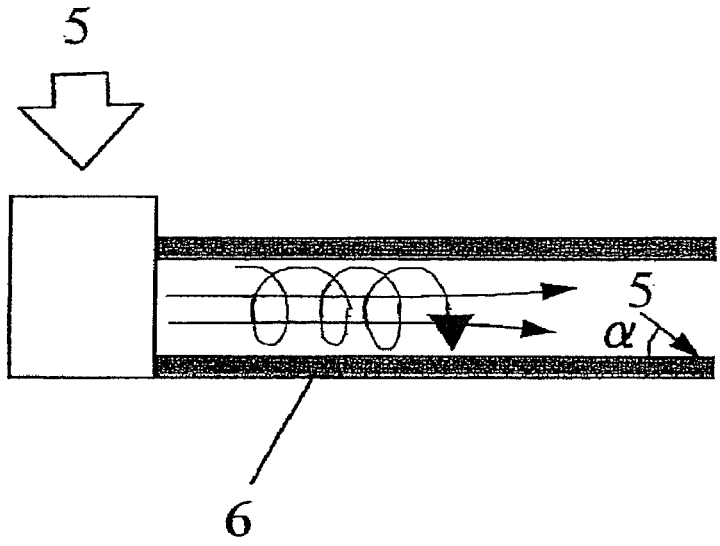

[Figure 5]
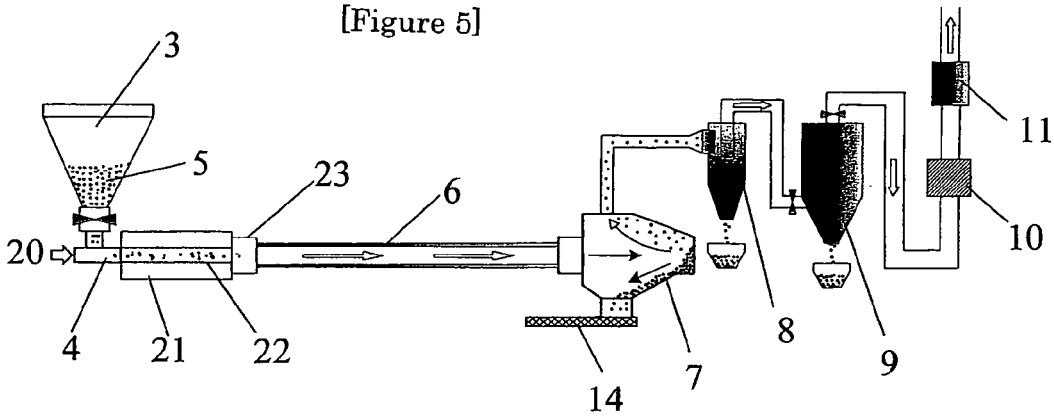
[Figure 6]
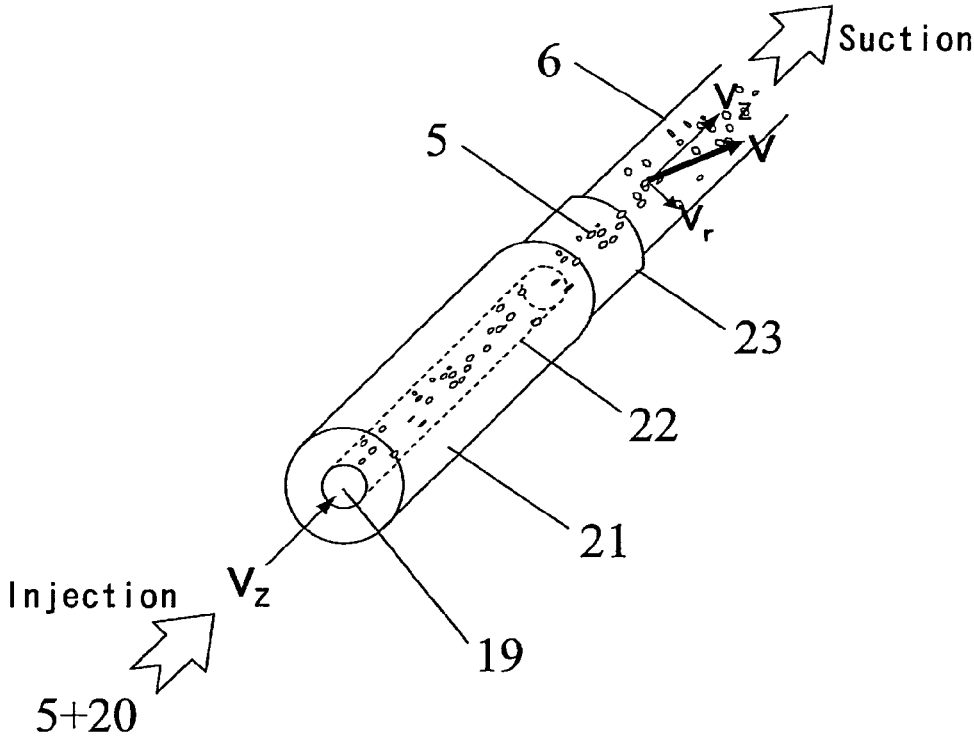

[Figure 7]
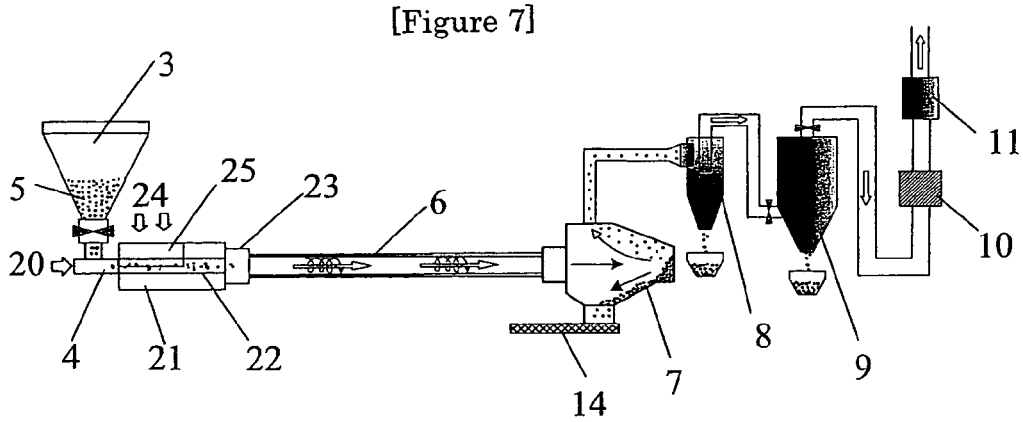
[Figure 8]
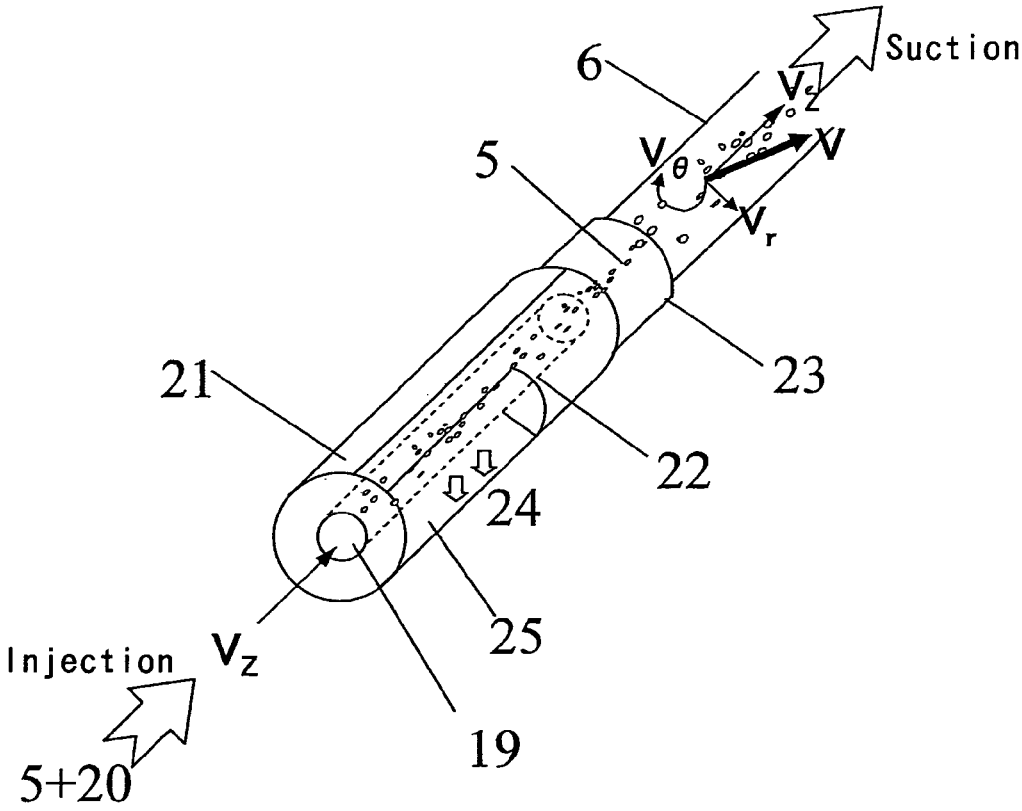

[Figure 9]
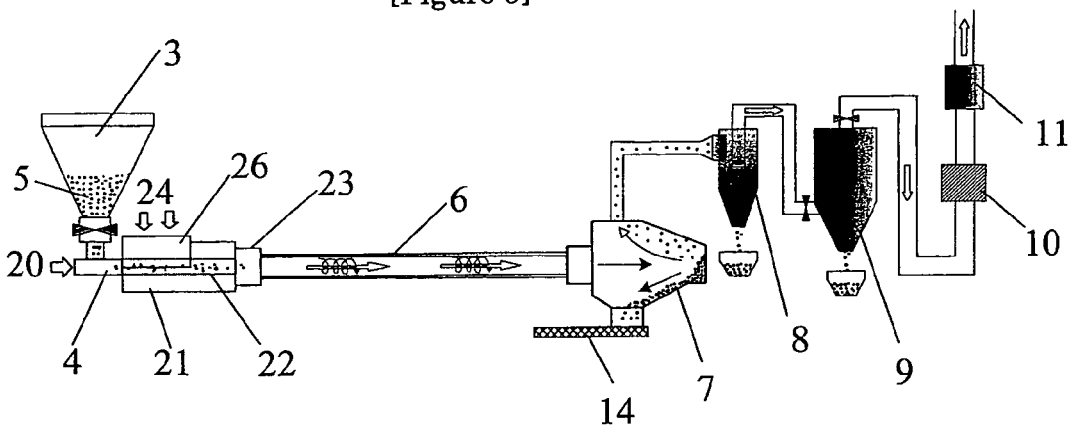
[Figure 10]
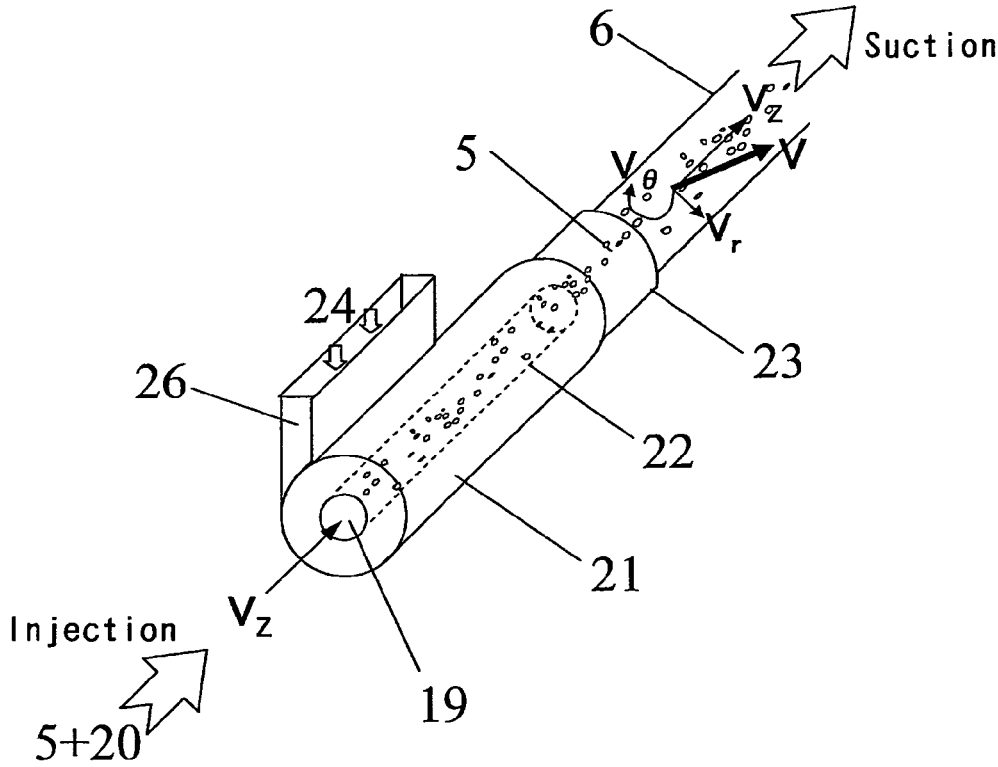

[Figure 11]
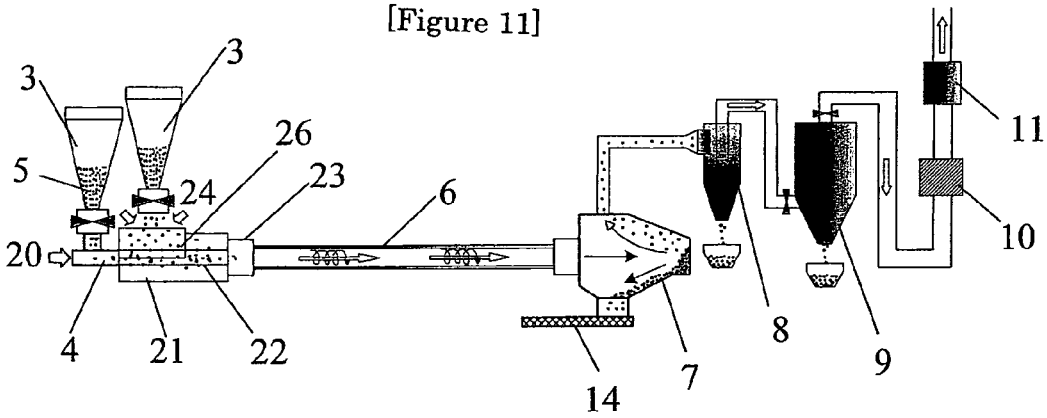
[Figure 12]
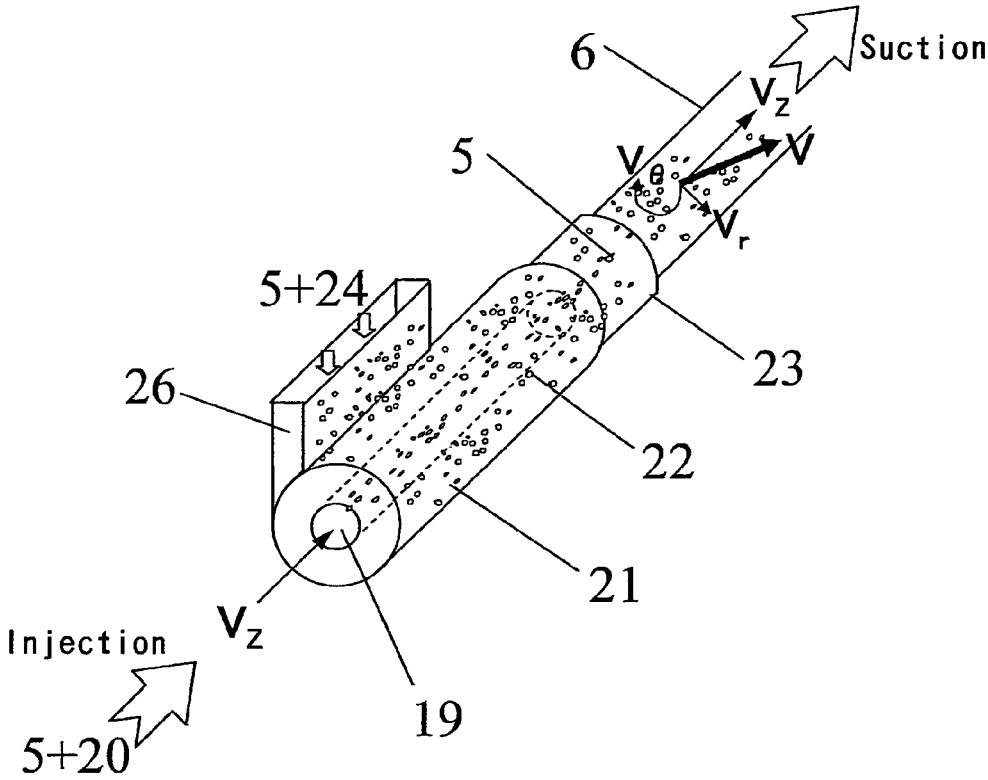

[Figure 13]
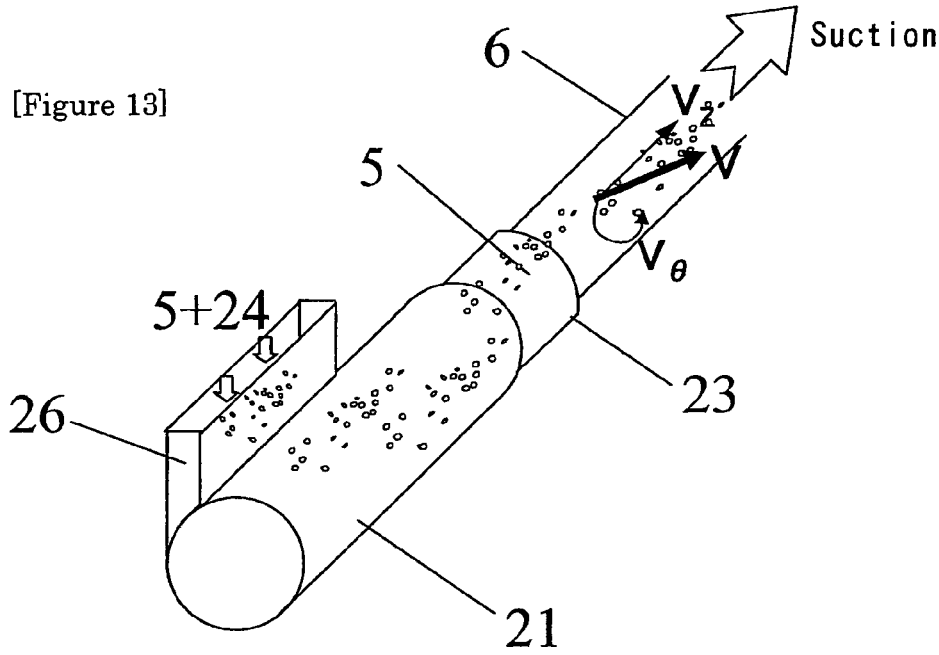
[Figure 14]
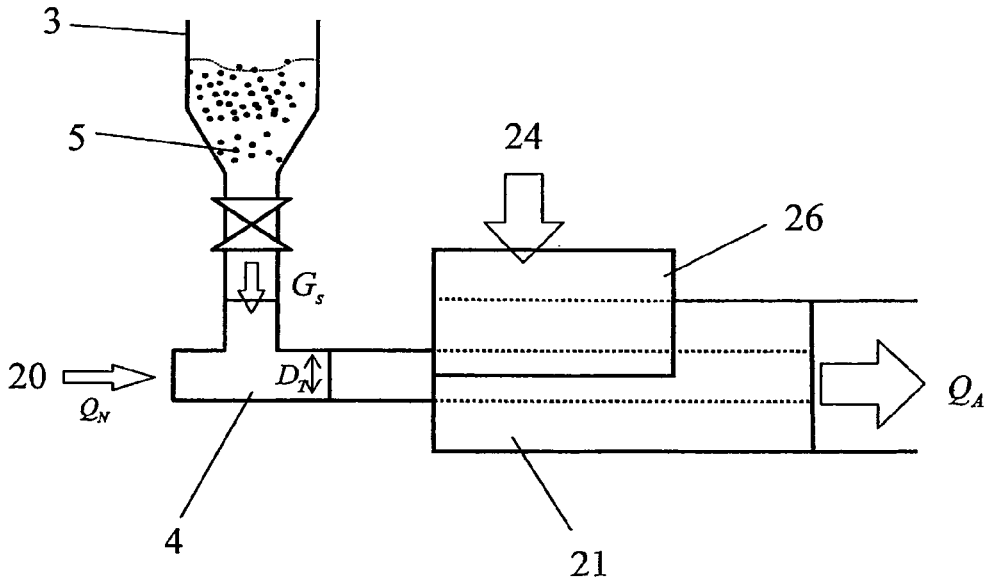

[Figure 15]
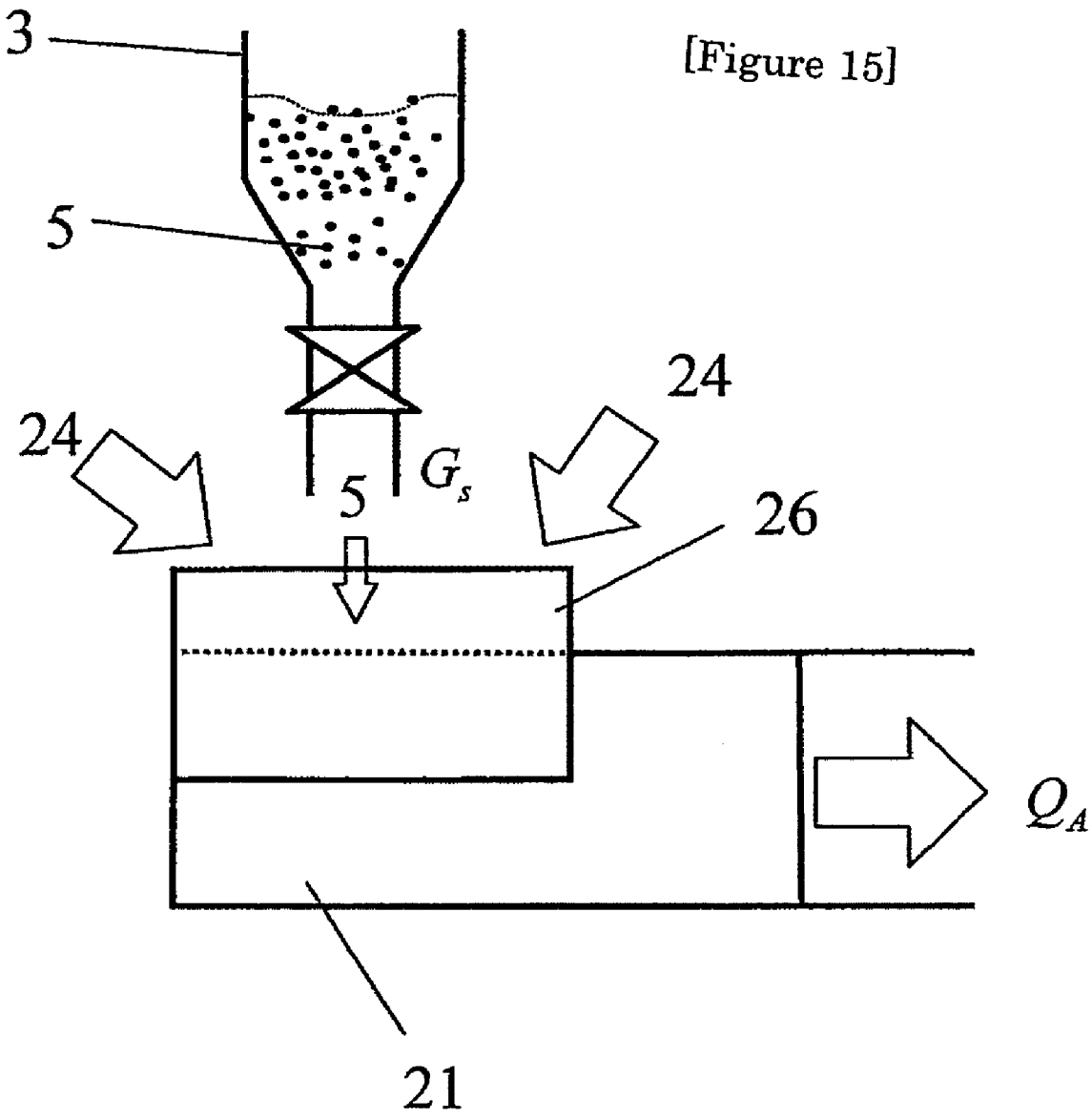

[Figure 16]
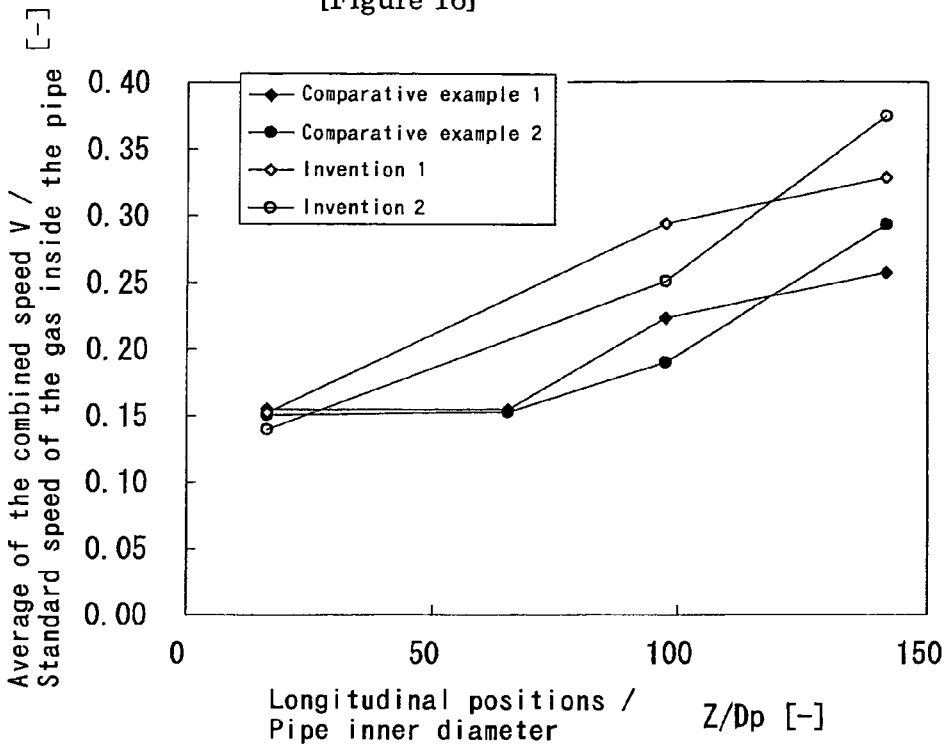
[Figure 17]
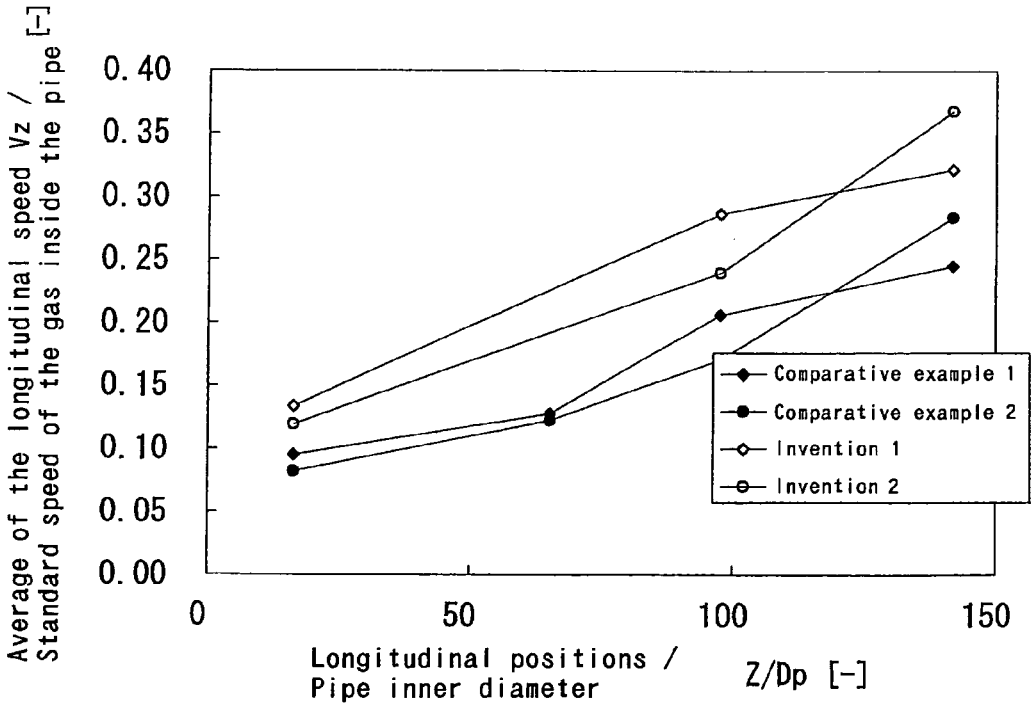

[Figure 18]
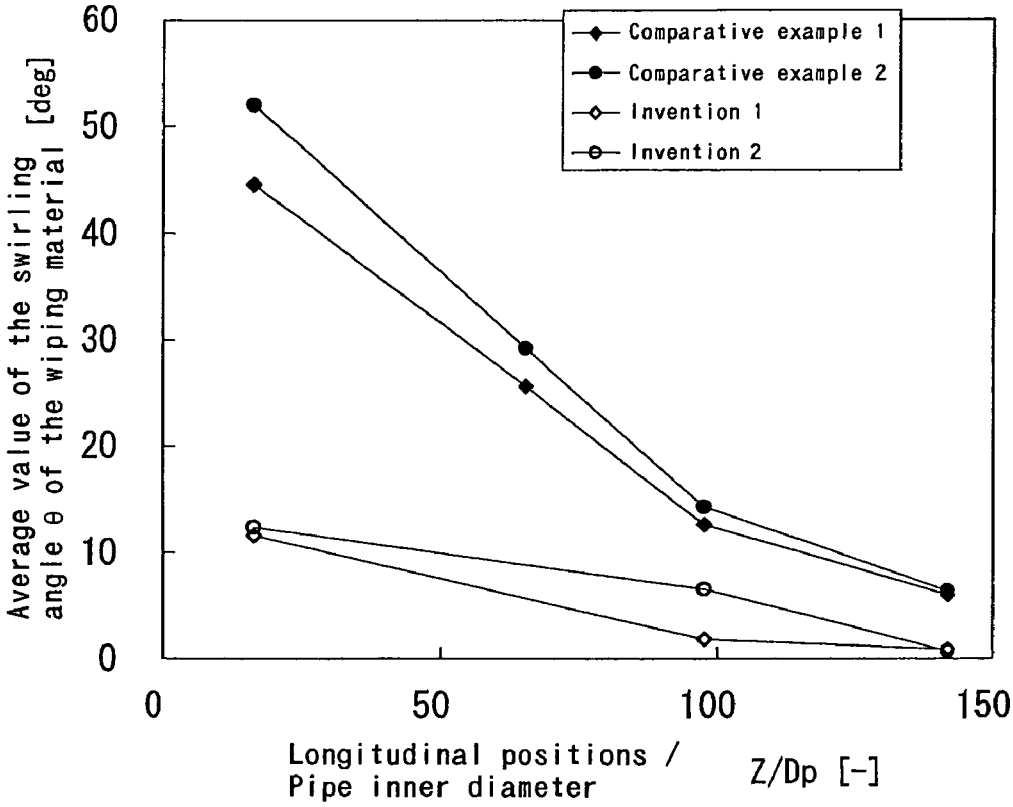

[Figure 19]
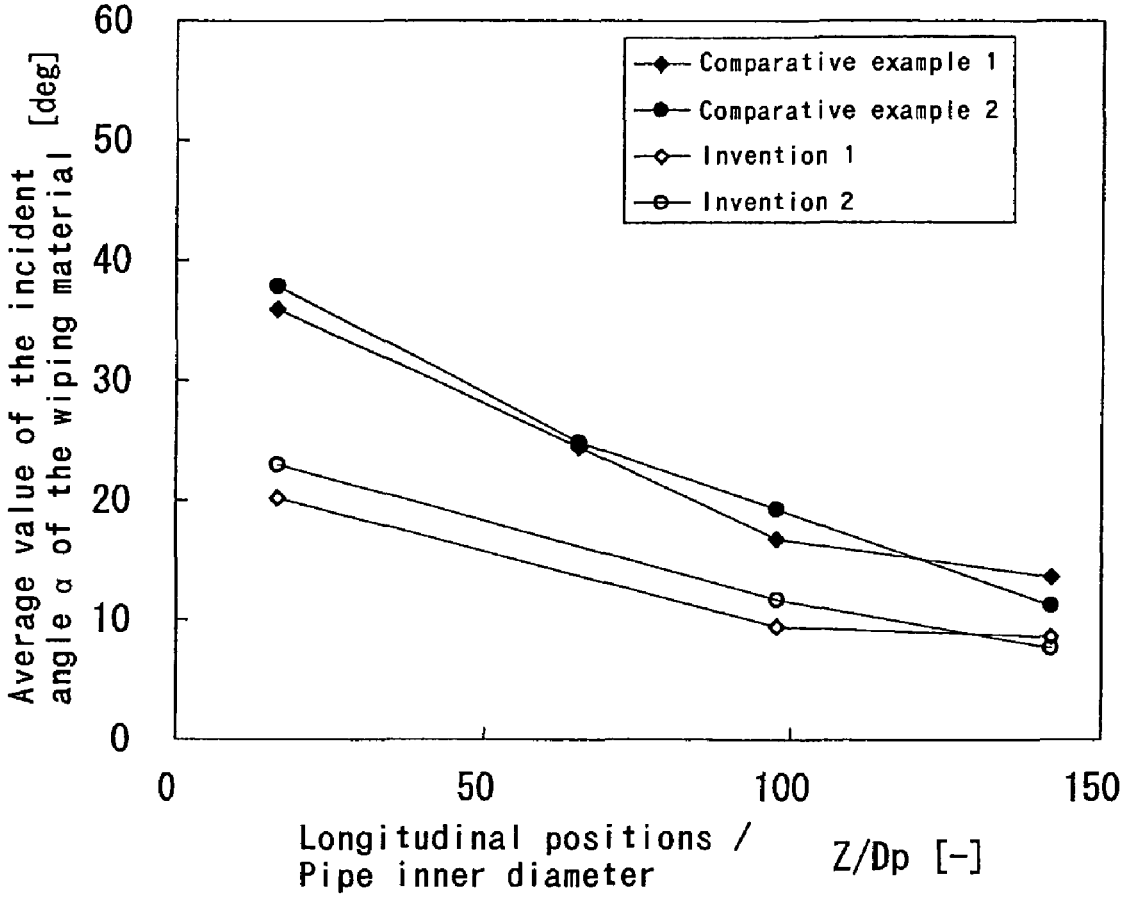

[Figure 20]
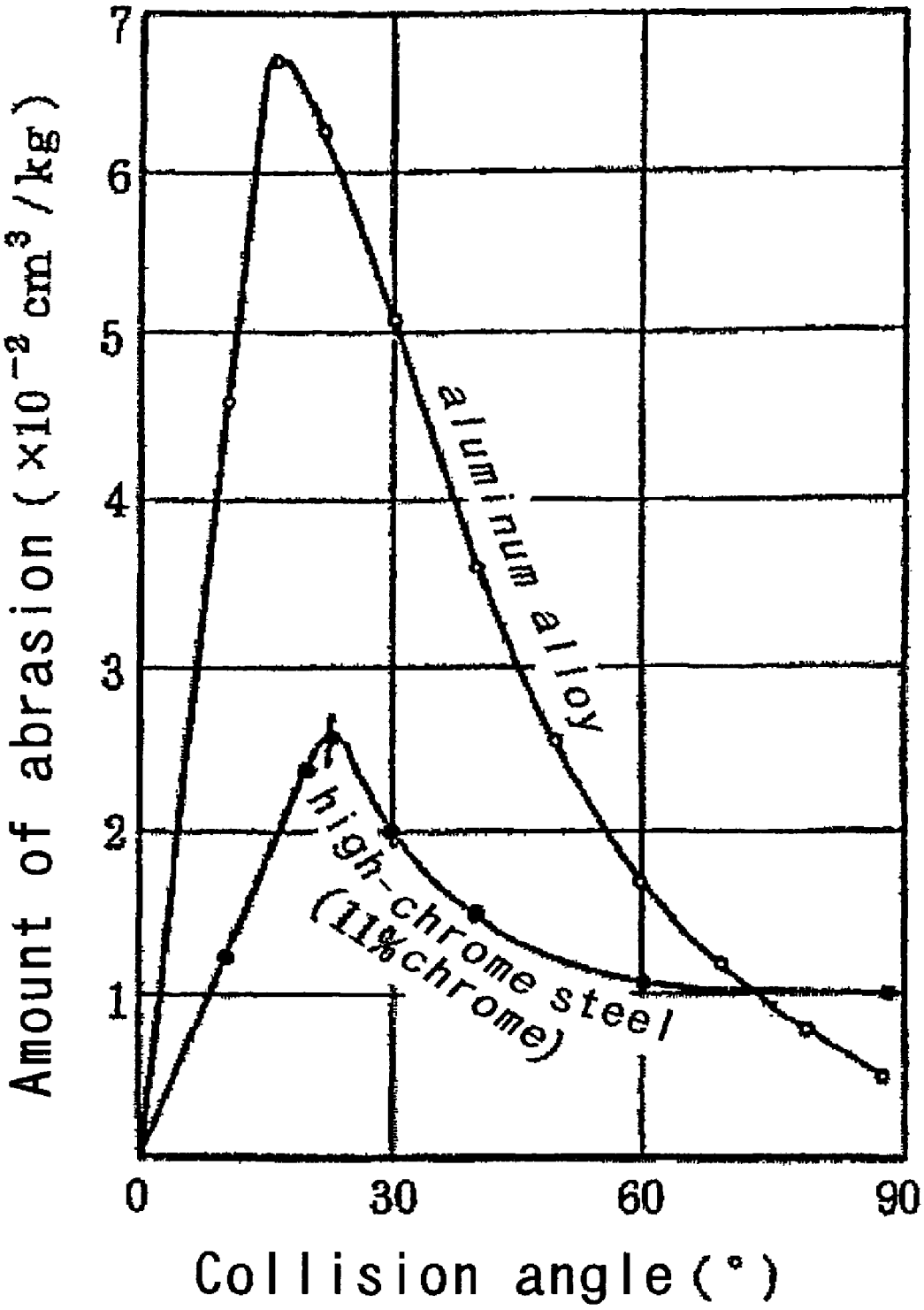

BLASTING DEVICE FOR STEEL PIPE INNER SURFACE, BLASTING METHOD FOR STEEL PIPE INNER SURFACE, AND METHOD FOR PRODUCING STEEL PIPE WITH EXCELLENT INNER SURFACE TEXTURE

This application is a continuation of International Patent Application No. PCT/JP2007/064735, filed Jul. 27, 2007. This PCT application was not in English as published under PCT Article 21(2).

TECHNICAL FIELD

The present invention relates to a blasting device for inner surface of a steel pipe capable of wiping or polishing the inner surface of a steel pipe by feeding a wiping or a polishing material onto the inner surfaces of various types of steel pipes via carrier fluid, a blasting method for steel pipe inner surface, and a method for producing a steel pipe with excellent inner surface texture.

BACKGROUND ART

A steel pipe with excellent inner surface texture is conventionally produced by a blasting device capable of wiping or polishing the inner surface of the steel pipe to remove scale on the inner surface of the steel pipe or polish the inner surface of the steel pipe by feeding a wiping or a polishing material via a carrier fluid from one end of the steel pipe and blasting the inner surface of the steel pipe with that wiping or polishing material.

These types of blasting devices are typically known as high-pressure injection blasting devices and negative-pressure suction blasting devices.

The high-pressure injection blasting device removes scale on the inner surface of the steel pipe or polishes the inner surface of the steel pipe by feeding a wiping or polishing material via high-pressure air as a carrier fluid and injecting this material into the steel pipe from one end to blast the inner surface of the steel pipe with this wiping or polishing material. The wiping or polishing material fed into the steel pipe by high-pressure air is then recovered in a recovery tank with filter, installed at the other end of the steel pipe.

In the negative-pressure suction blasting device on the other hand, the wiping or polishing material stored in a supply unit mounted near the beginning portion of the steel pipe is injected into the steel pipe from one end of the steel pipe, and air is suctioned from the other end of the steel pipe via a blower. Here, inside of the steel pipe is regulated to be negative-pressure, the wiping or polishing material is fed by a negative-pressure airflow generated by the negative-pressure and blasting the inner surface of the steel pipe with the wiping or polishing material to remove scale on the inner surface of the steel pipe or to polish the inner surface of the steel pipe. Note that, this wiping or polishing material fed inside the steel pipe by negative-pressure airflow is suctioned by a blower at the other end of the steel pipe and discharged outside the pipe. The wiping or polishing material is however recovered by any of a gravity drop type dust collector, cyclone, or dust collector with a filter provided between the other end of the steel pipe and the blower, or recovered by a combination thereof, and a portion of the wiping or polishing material is recycled.

In regard to such high pressure injection blasting device and negative-pressure suction blasting device, there is Patent document 1 described below. Along with describing respective problems with conventional high-pressure injection blasting devices and negative-pressure suction blasting devices, this document discloses a blasting device that is an improvement on conventional negative-pressure suction blasting devices. In other words, in a negative-pressure suction blasting device, when a wiping material or polishing material is fed to the vicinity of the beginning portion of the steel pipe by a negative-pressure airflow suctioned into a steel pipe resulting from negative pressure inside a steel pipe, it is proposed that a shape of supply part for a wiping or polishing material provided in the vicinity of beginning portion of the steel pipe should be improved in order to swirl the negative-pressure airflow.

[Patent document 1] JP 5-228842A

DISCLOSURE OF THE INVENTION

Problems to be Solved by the Invention

As described below, however, both the high-pressure injection blasting device and negative-pressure suction blasting device have the following problems.

The high-pressure injection blasting, device operation during blasting is first described based on FIG. 1. FIG. 1 illustrates the high-pressure injection blasting device shown in the above-described Patent document 1 as FIG. 12.

In this high-pressure injection blasting device, a compressor 1 for supplying a high-pressure air for spraying and feeding the wiping material, an air drier 2 for removing moisture liquefied in the high-pressure air during pressurization, a wiping material tank 3 for dropping the wiping material into the high-pressure airflow, and a wiping material/fluid mixing part 4 for mixing this wiping material into the high-pressure airflow are connected to one end of the pipe 6 for blasting. The other end of the pipe 6 is connected to a recovery tank 7 for receiving wiping material after wiping of the steel pipe 6 is finished and recovering a portion of this material, a cyclone 8 for separating an injection air and a granular wiping material not completely pulverized even after the wiping, a dust collector 9 for separating the injection air and the pulverized wiping material and a blower 10 for suctioning a wiping material after the wiping and a high-pressure air for floating and feeding this wiping material from the recovery tank 7 via the cyclone 8 and the dust collector 9 and sending an air from which the wiping material and wiped dust were removed, to silencer 11 for discharging.

This high-pressure injection blasting device feeds the wiping material by using the high-pressure airflow 20 as a carrier to blast the inner surface of the steel pipe 6 with the wiping material 5, thus blasting the inner surface of the steel pipe.

FIG. 2 is a schematic view showing the state when the wiping material 5 carried by high-pressure airflow 20 as the carrier blasts the inner surface of a steel pipe. The wiping material blasts the inner wall of the steel pipe at an incident angle $\alpha$.

In blasting using this high-pressure injection blasting device, operating conditions such as airflow rate, airflow static pressure, and the type and amount of wiping material are determined on the basis of quality, pipe inner diameter, length of the pipe 6 for blasting, and the blasting specifications. Static pressure is ordinarily set within 10 $Kg/cm^2$ when starting the high-pressure injection in order to ensure the flow rate. Particles such as garnet, alumina and sand from 10 μm to 5 mm in spherical-equivalent diameter are used as the wiping material.

Operating conditions are usually determined empirically. Test blasting is performed under the operating conditions, and these conditions are then revised to set the actual operating conditions. After setting these operating conditions, the compressor 1 is operated, the air drier 2 removes moisture occurring in the high-pressure air, a wiping material is dropped from a wiping material tank 3 into the high-pressure air, and a wiping material/fluid mixing part 4 for mixing the material in high-pressure air injects the mixture from one end of the pipe 6 onto the inner surface of the steel pipe 6. The wiping material fed while suspended in high-pressure air wipes the pipe inner surface, reaches the other end of the pipe 6, and is sprayed into a recovery tank 7 together with high-pressure air. The speed drops here and portions of the wiping material that were not pulverized are then recovered. Air containing the pulverized wiping material and dust is suctioned up by the blower 10. Relatively large pulverized wiping material and dust are separated by the cyclone 8. The finely pulverized wiping material and dust are separated by the dust collector 9. The wiping material and dust are then discharged into the atmosphere via the blower 10 and the silencer 11.

The case where using wiping material to wipe the inner surface of a steel pipe was described above. This same description also applies to the case where polishing the inner surface of a steel pipe using a polishing material. Note that, the polishing material is for example alumina powder, titanium powder, diamond powder with a spherical-equivalent diameter of approximately 0.1 μm to 100 μm In high-pressure injection blasting device however, when high-pressure air for feeding the wiping or polishing material is injected into a steel pipe from an injection hole, the high-pressure air becomes a laminar airflow when injected at a low speed. The wiping or polishing material does not sufficiently accelerate in this laminar airflow region so the wiping or polishing performance is inadequate.

Next, the steel pipe must be rotated along its axial center in order to uniformly wipe or polish the inner surface of the steel pipe over the entire surface along the circumference. However, since the wiping effect acts on only an extremely localized position in the vicinity of the injection port, the wiping effect is not uniform due to factors such as pressure variations in the high-pressure air, variations in particle inflow quantities, irregular steel pipe rotation speed, and irregular moving speed of particle-injection port. To resolve this problem, injecting the high-pressure air from multiple injection holes was proposed to make the wiping performance uniform. However this method still requires rotating the pipe, so the blasting device becomes more complicated, and operation efficiency deteriorates.

The wiping or polishing material loses kinetic energy on one collision. Since there is no mechanism to reaccelerate the particles after collision within the high-pressure injection blasting device, the wiping must be performed over the entire surface of the pipe while moving the particle injection port longitudinally along the pipe, so a large quantity of wiping or polishing material is required.

Further, in the high-pressure injection blasting device there are also problems with the wiping or polishing material solid-to-air ratio (amount of wiping or polishing material per unit volume of air). When mixing the wiping or polishing material with high-pressure air, the upper limit where the high-pressure air suspends and feeds the wiping or polishing material is a volumetric ratio of 1-to-1 (wiping or polishing material/air). Even if wiping or polishing material is mixed with high-pressure air beyond this upper limit, the high-pressure air injected into the steel pipe expands and depressurizes causing the volume to increase, so that the solid-to-air ratio in the steel pipe becomes very small, and consequently lowers the wiping or polishing material blasting effect.

In contrast, the operation when using negative-pressure suction blasting device is described next in FIG. 3. FIG. 3 illustrates the negative-pressure suction blasting device shown in Patent document 1 as FIG. 1.

In this negative-pressure suction blasting device, a recovery tank 7 is installed at the end of the pipe 6 for blasting to receive the wiping material after the wiping the inner surface of the pipe 6 and the negative-pressure airflow suspending and carrying the wiping material, and to separate the air and the non-pulverized wiping material. A discharging means 14 (The separated wiping material is returned here to the wiping material tank 3.) is also installed here to discharge the wiping material separated by the recovery tank 7.

A cyclone 8 for separating the pulverized wiping material and wiping waste from the negative-pressure air and a dust collector 9 are connected to a Blower 10 which suctions the wiping material after the wiping and the negative-pressure airflow suspending and carrying the wiping material from the blasted pipe 6 via the recovery tank 7, the cyclone 8, and the dust collector 9, and sends the air that the wiping material and wiping waste was removed, to the silencer 11 for discharging. A blower 10 connected to the dust collector 9, and t, suctions the used wiping material and wiping material suspended in the negative-pressure airflow from the blasted pipe 6 via the recovery tank 7, the cyclone 8, and the dust collector 9, and sends the air from which the wiping material and wiping waste was removed, to the silencer 10 for discharging.

A wiping material-air supply unit 13 for supplying wiping material and a negative-pressure airflow suspending and carrying the wiping material to the inside of the pipe 6 is connected to the beginning portion of the pipe 6. Wiping material is dropped from a wiping material tank 3 in this wiping material-air supply unit 13, the wiping material and the negative-pressure airflow suspending and carrying the wiping material are supplied to the inside of the pipe 6 by a negative-pressure suction effect, so the inner surface of the pipe 6 is wiped by this wiping material suspended and fed by the negative-pressure airflow. The wiping material after the wiping and negative-pressure airflow are then suctioned from the pipe 6 and discharged.

A turbulent flow means (not shown) is installed in the wiping material-air supply unit 13. The wiping material is suspended in the negative-pressure airflow in a turbulent state and is fed by the airflow. The wiping material therefore contacts the inner surface of the pipe 6 for blasting in a turbulent state.

Using this negative-pressure suction blasting device, the inner surface of a steel pipe is blasted by feeding the wiping material 5 suspended in negative-pressure airflow as the carrier and blasting the inner surface of the steel pipe 6 with the wiping material.

FIG. 4 is a schematic view showing the state when wiping material 5 fed by a negative-pressure airflow 15 as a carrier blasts the inner surface of a steel pipe 6. The wiping material blasts the inner wall of a steel pipe at an incident angle $\alpha$.

In blasting using this negative-pressure suction blasting device, operating conditions such as the negative pressure and flow rate of the negative pressure airflow, and the type and amount of wiping material are determined based on material quality, pipe inner diameter, length of the pipe 6 for blasting, and the blasting specifications the same as in high-pressure injection blasting. The negative pressure is ordinarily set from 0 to −1 $Kg/cm^2$. Particles such as garnet, alumina and sand from 10 μm to 5 mm in spherical-equivalent diameter are used as the wiping material the same as in high-pressure injection blasting.

Operating conditions are usually determined empirically. Test blasting is performed under the operating conditions, and these conditions are then revised to set the actual operating conditions. After setting these operating conditions, wiping material is dropped from the wiping material tank 3 into a wiping material-air supply unit 13, and the wiping material is supplied by a negative-pressure suction effect inside the pipe 6 for blasting, the wiping material being fed while suspended in this negative-pressure airflow wipes the pipe inner surface, reaches the end of the pipe 6, and is recovered by either one of a gravity drop type dust collector 7, cyclone 8, or dust collector 9 with filter, or by a combination thereof. A carrier gas containing only ultrafine particles is discharged into the atmosphere via the blower 10 and the silencer 11. A portion of the wiping material that was not pulverized is recovered by a gravity drop type dust collector 7 and/or cyclone 8, and is recycled in the wiping material tank 3 mechanically and/or by a fluid feeding means 14.

Using the wiping material to wipe the inner surface of a steel pipe was described above. This same description also applies to the case where polishing the inner surface of a steel pipe using a polishing material. The polishing material is for example alumina powder, titanium powder, diamond powder with a spherical-equivalent diameter of approximately 0.1 μm to 100 μm.

In negative-pressure suction blasting devices, a negative-pressure suction generated by a blower suctions a negative-pressure airflow feeding a wiping or polishing material from an air supply pipe. In this state, a wiping or polishing material supplied from a wiping or polishing material supply unit is mixed with a negative-pressure airflow, which suspends the wiping/polishing material and feeds it toward a blower, so that the speed of a suspended wiping or polishing material fed by this negative-pressure airflow may reach about 20 to 50% of the air speed of a negative-pressure airflow inside a steel pipe, which is sufficient to wipe or polish the inner surface of the pipe. Therefore, even in cases of a steel pipe with a large inner diameter, the air speed inside the steel pipe does not drop, and the end portion of a large diameter steel pipe can be uniformly wiped and polished. Moreover the wiping and polishing can be performed without rotating the steel pipe.

Since the speed of a wiping or polishing material suspended and fed by this negative-pressure airflow may reach 20 to 50% of the negative-pressure airflow speed inside the steel pipe, the difference between the static pressure when a wiping or polishing material supplied from the supply unit mixes with the negative-pressure airflow and the static pressure when a wiping or polishing material passes through the interior of a steel pipe are small compared with high-pressure injection blasting device, so wiping or polishing material can be mixed with a negative-pressure airflow up to the upper limit for suspending and feeding the wiping or polishing material.

Consequently the problem of lowering the solid-to-air ratio of wiping or polishing material (amount of wiping or polishing material per unit volume of air) encountered in high-pressure injection blasting device can be ignored.

However, in negative-pressure suction blasting devices, since the wiping or polishing material stored in a supply device installed near the beginning portion of a steel pipe is injected from one end of a steel pipe, and the air inside the steel pipe is suctioned from the other end by a blower, the particle density or particle speed may not be sufficient to blast the inner surface near the beginning section of the steel pipe. In those cases, wiping or polishing the beginning portion of the steel pipe sufficiently is impossible.

In the negative-pressure suction blasting device in Patent document 1 described above, when a wiping material or polishing material is fed to the vicinity of the beginning portion of the steel pipe by a negative-pressure airflow suctioned into a steel pipe resulting from negative pressure inside a steel pipe, it is proposed that a shape of supply part for a wiping or polishing material provided in the vicinity of beginning portion of the steel pipe should be improved in order to swirl the negative-pressure airflow. However this swirl component air speed weakens in the end section causing the problem that the blast effect deteriorates.

The present invention has the object of resolving the aforementioned problems of the conventional art by providing a blasting method for steel pipe inner surface and a blasting device for steel pipe inner surface that delivers improved blast performance and adequately blasts the inner surface of the steel pipe from the beginning portion to the end portion.

Means to Solve the Problems

The present inventors made various studies on how to provide a blasting device for steel pipe inner surface with improved blast performance as well as the capability to sufficiently blast the inner surface of the steel pipe from the beginning portion to the end portion of the steel pipe and to provide a blasting method for steel pipe inner surface as the same. As a result, findings of the following (a) to (h) were obtained (a) Wiping or polishing material should be injected into the steel pipe by using high pressure fluid as a carrier in order to thoroughly blast the inner surface of the beginning portion of the steel pipe. To ensure an air speed capable of blasting the inner surface of the beginning portion of the steel pipe, the steel pipe should be placed horizontally, a tubular carrier fluid inflow unit provided in the beginning portion of the steel pipe, and the wiping or polishing material injected into the carrier fluid inflow unit in a horizontal direction along with the carrier fluid from a hole formed in the edge face of the tubular carrier fluid inflow unit. Note that, the hole for injecting the wiping or polishing material into the carrier fluid inflow unit in a horizontal direction together with the carrier fluid, is preferably formed in the center of the edge face of the tubular carrier fluid inflow unit.

(b) In this case, the wiping or polishing material can surely blast the inner surface of a steel pipe from the beginning portion when a dummy pipe is provided between the beginning portion of the steel pipe and the tubular carrier fluid inflow unit provided horizontally with each other, and the inner surface is blasted together with a part of the dummy pipe. Therefore, it is preferable that the beginning portion of the steel pipe and the tubular carrier fluid inflow unit are connected via a dummy pipe, and the beginning portion of the steel pipe is positioned downstream from the position where the wiping or polishing material starts blasting the inner wall.

(c) A stable air speed for injecting carrier fluid can be ensured when a shaft tube is provided concentrically and within the tube of the tubular carrier fluid inflow unit, and a carrier fluid feeding a wiping material or polishing material injected into horizontally from a hole formed on the edge face of the tubular carrier fluid is passed through this shaft tube. By adjusting the length, exit diameter, exit shape of this shaft tube, and the speed of carrier fluid, a carrier fluid that feeds the wiping or polishing material injected into it can be blasted against the beginning portion of the steel pipe at a predetermined angle. The wiping or polishing material fed by a carrier fluid can therefore be adjusted to start blasting exactly from the inner surface of the beginning portion of the steel pipe. Hence, it is preferable that a shaft tube coaxial with a tube of the carrier fluid inflow unit is provided inside of the tubular carrier fluid inflow unit.

(d) Moreover, in order to blast the inner surface of a steel pipe sufficiently from the beginning portion to the end portion across the entire surface, the particles are preferably dispersed across the entire cross section in such a manner that in addition to forming a horizontal flow by injecting a wiping or polishing material horizontally into a tubular carrier fluid inflow unit together with the carrier fluid, the carrier fluid feeding the wiping or polishing material is made to swirl on the inner surface of the steel pipe by combining with the flow rotating circumferentially around the inner surface of the steel pipe to make the wiping or polishing material curl upwards to the upper surface within the steel pipe.

(e) This type of rotating flow along the circumference on the inner surface of a steel pipe is generated by forming one or more air inflow ports to allow air to flow into a carrier fluid inflow unit in a tube section of the carrier fluid inflow unit. In order to circumferentially rotate the airflow flowing from the air inflow port on the inner surface of the steel pipe, the airflow is preferably guided from the air inflow port circumferentially along the inner wall of the tubular carrier fluid inflow unit. More specifically, an air flow injected into or suctioned from the air inflow port is preferably guided upwards or downwards along the inner wall of the tubular carrier fluid inflow unit, by installing a whistle-shaped air feed apparatus in the air inflow port.

(f) In contrast to this, to ensure that the inner surface at the end portion of the steel pipe is blasted sufficiently, the air inside the steel pipe is preferably suctioned from the end portion of the steel pipe so that the interior of the steel pipe reaches a negative pressure, and in this way ensure an air speed necessary for blasting even the end portion of the steel pipe.

(g) Sufficient blasting can in this way be obtained from the beginning portion to the end portion of the steel pipe by injecting a wiping or polishing material into a steel pipe with high-pressure fluid as a carrier, and also by suctioning air inside the steel pipe from the end portion of the steel pipe so that the interior of the steel pipe reaches a negative pressure. Namely, in both high-pressure injection blasting devices and negative-pressure suction blasting devices, the blasting is incomplete on portions of the steel pipe but by utilizing hybrid type blasting device that combines high-pressure injection and negative-pressure suction, blasting can be sufficiently performed from the beginning portion to the end portion of the steel pipe.

(h) Utilizing hybrid type blasting device that combines high-pressure injection and negative-pressure suction increases the wiping or polishing material feed speed from the beginning portion to the end portion of the steel pipe, so that the velocity at which the wiping or polishing material blasts the inner surface of the steel pipe is increased. Since there is greater kinetic energy when the wiping or polishing material blasts the inner surface of the steel pipe, the blasting performance on the inner surface of a steel pipe is improved.

Further, the blasting performance of the inner surface of the steel pipe can be improved by feeding a wiping or polishing material from an air inflow port of the carrier fluid inflow unit in addition to injecting the wiping or polishing material horizontally into the carrier fluid inflow unit along with the carrier fluid.

The present invention was completed based on this new findings, and blasting device for steel pipe inner surface according to the present invention is based on any one of the following gist (1) to (9). The blasting method for steel pipe inner surface according to the present invention is based on the following gist (10). The production method for a steel pipe with excellent inner surface texture according to the present invention is based on the following gist (11). Hereinafter, each is referred as to the present inventions (1) to (11). In some cases the present inventions (1) to (11) are collectively referred to as the present invention.

(1) A blasting device for steel pipe inner surface, comprising a tubular carrier fluid inflow unit connected to one end of a steel pipe installed horizontally, and a negative-pressure suction unit connected to other end of the steel pipe, wherein a wiping material or a polishing material is injected into the carrier fluid inflow unit horizontally along with carrier fluid from a hole formed in an edge face of the tubular carrier fluid inflow unit.

(2) A blasting device for steel pipe inner surface, comprising a tubular carrier fluid inflow unit connected to one end of a steel pipe installed horizontally, and a negative-pressure suction unit connected to other end of the steel pipe, wherein a wiping material or a polishing material is injected into the carrier fluid inflow unit horizontally along with a carrier fluid from a hole formed in a center of an edge face of the tubular carrier fluid inflow unit.

(3) A blasting device for steel pipe inner surface as described in (1) or (2), in which a dummy pipe connects the one end of the steel pipe installed horizontally and the tubular carrier fluid inflow unit.

(4) The blasting device for steel pipe inner surface described in any one of (1) to (3), wherein a shaft tube concentric with a tube of the carrier fluid inflow unit is installed inside the tubular carrier fluid inflow unit.

(5) The blasting device for steel pipe inner surface described in any one of (1) to (4), wherein at least one air inflow port for feeding air into the carrier fluid inflow unit is formed in a tube portion of the tubular carrier fluid inflow unit.

(6) The blasting device for steel pipe inner surface as described in (5), wherein a whistle-shaped air introducing apparatus is installed in at least one air inflow port.

(7) The blasting device for steel pipe inner surface as described in (5) or (6), wherein in addition to injecting the wiping material or polishing material horizontally into the carrier fluid inflow unit along with the carrier fluid, the wiping material or polishing material is also supplied from the air inflow port of the carrier fluid inflow unit.

(8) The blasting device for steel pipe inner surface described in any one of (5) to (7), wherein the air fed from the air inflow port forms a swirl flow along an inner wall of the tubular carrier fluid inflow unit.

(9) The blasting device for steel pipe inner surface as described in any one of (1) to (8), wherein the steel pipe is a martensite stainless steel pipe.

(10) A blasting method for steel pipe inner surface utilizing the blasting device for steel pipe inner surface described in any one of (1) to (9).

(11) A production method for a steel pipe with excellent inner surface texture, wherein the steel pipe inner surface are wiped or polished utilizing the blasting device for steel pipe inner surface as described in any one of (1) to (9).

EFFECT OF THE INVENTION

The present invention provides a blasting device for steel pipe inner surface with improved blast performance as well as the capability to sufficiently blast the inner surface of the steel pipe from the beginning portion to the end portion; a blasting method for steel pipe inner surface; and a method for producing a steel pipe with excellent inner surface texture.

BEST MODE FOR CARRYING OUT THE INVENTION

The present invention is hereinafter described based on the drawings. Note that, the present invention is not limited to the embodiments. The following embodiment describes using wiping material. Needless to say, however, the case where using polishing material is the same.

First Embodiment

FIG. 5 is an example of blasting device for steel pipe inner surface according to the present invention, and shows an overall view of the blasting device for steel pipe inner surface.

This blasting device for steel pipe inner surface is hybrid type blasting device that combines both high-pressure injection and negative-pressure suction by injecting a wiping material into a pipe 6 for blasting with high-pressure fluid as the carrier fluid 20, and also suctioning air inside the steel pipe from the end portion of the steel pipe 6 so that the interior of the steel pipe reaches a negative pressure. Since pressure fluctuations in the carrier fluid are small from the beginning portion to the end portion across the entire pipe 6 (steel pipe) for blasting, the flow speed necessary to blast the inner surface of the steel pipe is sufficiently ensured in the pipe (steel pipe) 6 for blasting.

In this blasting device for steel pipe inner surface, the wiping material stored in the wiping material tank 3 is dropped into the high-pressure airflow 20 supplied from a compressor (not shown), and a wiping material/fluid mixing part 4 for mixing this wiping material with high-pressure air is installed at the beginning edge side of the pipe 6 (steel pipe) for blasting via the tubular carrier fluid inflow unit 21 and dummy pipe 22.

A gravity drop type recovery tank 7 for receiving the used wiping material after wiping the internal surface of the pipe 6 and the negative-pressure air flow suspending and carrying the wiping material, and then separating this wiping material and the air, is installed at the end portion of the pipe (steel pipe) 6 for blasting. A blower 10 for discharging the air, from which wiping waste and wiping material other than ultrafine particles were removed, to the silencer 11, is connected to the recovery tank 7 via the cyclone 8 and dust collector 9. A portion of the wiping material is recovered by a gravity drop type dust collector 7 and/or cyclone 8, and is recycled in the wiping material tank 3 mechanically and/or by the fluid feeding means 14.

FIG. 6 shows an enlarged view (perspective view) of a tubular carrier fluid inflow unit in the blasting device for steel pipe inner surface shown in FIG. 5.

A tubular carrier fluid inflow unit 21 includes a hole 19 in the center of edge face of the tubular carrier fluid inflow unit 21 for injecting the wiping material horizontally inside the carrier fluid inflow unit 21 along with the carrier fluid 20.

The carrier fluid inflow unit 21 includes a shaft tube 22 coaxial with the tube of the carrier fluid inflow unit. The carrier fluid 20 for feeding wiping material injected horizontally from a hole 19 formed in the edge face of tubular carrier fluid inflow unit 21, is injected into this shaft tube at a longitudinal speed $V_z$ and passed through the shaft tube at a longitudinal speed $V_z$. Due to expansion of the carrier fluid injection flow, a radial speed $V_r$ is added to the carrier fluid 20 horizontally feeding the wiping material after passing in the shaft tube.

In other words, after passing through the shaft tube, a radial speed $V_r$ is added to the longitudinal speed $V_z$ of the wiping material fed by the carrier fluid 20, and the wiping material is blasted onto the pipe 6 (a steel pipe) for blasting at a speed V shown in the following formula (1).

$$V=(V_z^2+V_r^2)^{1/2} \quad \text{Formula (1)}$$

The length of the shaft tube 22 is set to the same as the length of carrier fluid inflow unit 21, but the carrier fluid 20 for feeding the injected wiping material can be made to blast at a specified angle and specified position by adjusting the length of shaft tube 22 and the speed of carrier fluid 20. The length of shaft tube 22 may therefore preferably be set so that the wiping material fed by the carrier fluid 20 starts blasting the inner surface exactly from the beginning portion of the steel pipe.

A dummy pipe 23 is installed here between the beginning portion of the steel pipe and the tubular carrier fluid inflow unit 21 provided horizontally with each other. Installing the dummy pipe 23, allows blasting the inner surface including a portion of dummy pipe 23, so that a wiping material can completely blast the pipe starting from the beginning portion of the steel pipe inner surface.

Second Embodiment

FIG. 7 is other example of the blasting device for steel pipe inner surface according to the present invention, and shows an overall view of the blasting device for steel pipe inner surface.

This embodiment is hybrid type blasting device that combines high-pressure injection and negative-pressure suction. This embodiment operates in the same manner as the blasting device for steel pipe inner surface of the first embodiment by injecting a wiping material into pipe 6 (steel pipe) for blasting with high-pressure fluid as the carrier fluid 20, and also suctioning air inside the steel pipe from the end portion of the steel pipe 6 so that the interior of the steel pipe reaches a negative pressure.

However, the tubular carrier fluid inflow unit 21 for injecting wiping material into a pipe (steel pipe) 6 for blasting with high-pressure fluid as the carrier fluid 20 includes an air inflow port 25 for feeding air 24 into the carrier fluid inflow unit 21. A swirl flow is formed along the inner wall of carrier fluid inflow unit 21 by the air 24 suctioned or injected from this air inflow port. A wiping material 5 injected in horizontally along with the carrier fluid 20 is injected into the carrier fluid inflow unit 21 horizontally after being mixed with the carrier fluid 20 in the wiping material/fluid mixing part 4.

Also, since pressure fluctuations in the carrier fluid are small from the beginning portion to the end portion across the entire pipe 6 (steel pipe) for blasting, the flow speed necessary to blast the inner surface of the steel pipe is sufficiently ensured in the pipe (steel pipe) 6 for blasting.

In this blasting device for steel pipe inner surface, the wiping material stored in the wiping material tank 3 is dropped into the high-pressure airflow 20 supplied from a compressor (not shown), and a wiping material/fluid mixing part 4 for mixing this wiping material with high-pressure air is installed at the beginning edge side of the pipe 6 (steel pipe) for blasting via the tubular carrier fluid inflow unit 21 and dummy pipe 22. The structure of this wiping material/fluid mixing part 4 is the same as the mixing part shown in FIG. 2. A high-pressure airflow 20 supplied through a nozzle 16 and a wiping material 5 supplied through a feeder 17 are mixed in a diffuser 18 and fed to a carrier fluid inflow unit 21.

A recovery tank 7 for receiving the used wiping material after wiping the internal surface of the pipe 6 and the negative-pressure air flow suspending and carrying the wiping material, and then separating the non-pulverized wiping material and the air, is installed at the end portion of the pipe (steel pipe) 6 for blasting. A discharging means 14 (The separated wiping material is returned here to the wiping material tank 3.) for discharging the wiping material separated by the recovery tank 7 is also installed. Also, a cyclone 8 and a dust collector 9 for separating the pulverized wiping material and wiped dust from the negative-pressure airflow, and a blower 10 for suctioning the used wiping material after the wiping and the negative pressure air flow suspending and carrying the wiping material from the pipe 6 for blasting via the cyclone 8 and dust collector 9 and discharging the air from which wiping material and wiping waste were removed, to the silencer 11, are connected to the recovery tank 7.

FIG. 8 shows an enlarged view (perspective view) of a tubular carrier fluid inflow unit in the blasting device for steel pipe inner surface according to the second embodiment.

The tubular carrier fluid inflow unit 21 includes a hole 19 in the center of the edge face of the tubular carrier fluid inflow unit 21 for injecting a wiping material horizontally into the carrier fluid inflow unit 21 along with the carrier fluid 20. The tubular carrier fluid inflow unit 21 includes an air inflow port 25 for feeding the air 24 into the carrier fluid inflow unit 21. A swirling flow is formed along the inner wall of the carrier fluid inflow unit at a circumferential speed $V_\theta$ by the air 24 suctioned or injected in from this air inflow port 25.

Here, the carrier fluid inflow unit 21 includes a shaft tube 22 coaxial with the tube of the carrier fluid inflow unit, and the carrier fluid 20 for feeding wiping material injected in horizontally from the hole 19 formed in the edge face of the tubular carrier fluid inflow unit 21, is injected into this shaft tube at a longitudinal speed $V_z$ and passed through the shaft tube at a longitudinal speed $V_z$.

A swirl flow formed by air 24 fed from the air inflow port 25 is therefore applied to the carrier fluid 20 for horizontally feeding the wiping material after passing through the shaft tube, and that speed is a combination of a longitudinal speed $V_z$, a circumferential speed $V_\theta$ and radial speed $V_r$.

In other words, after passing through the shaft tube, a wiping material fed by the carrier fluid 20 is blasted onto the pipe 6 (steel pipe) for blasting at a speed V shown in the following formula (2).

$$V=(V_z^2+V_\theta^2+V_r^2)^{1/2} \quad \text{Formula (2)}$$

Also, the length of shaft tube 22 is set to the same length as the carrier fluid inflow unit 21, but since the carrier fluid 20 for feeding the injected wiping material can be made blasted against the beginning portion of the steel pipe at a specified angle by adjusting the length of this shaft tube 22 and speed of carrier fluid 20, the length of shaft tube 22 may preferably be set so that the wiping material fed by the carrier fluid 20 starts blasting the inner surface exactly from the beginning portion of the steel pipe.

A dummy pipe 23 is installed between the beginning portion of the steel pipe and the tubular carrier fluid inflow unit 21 provided horizontally with each other. Installing the dummy pipe 23 allows blasting the inner surface including a part of the dummy pipe 23, so that a wiping material can completely blast the pipe starting from the beginning portion of the steel pipe inner surface.

Third Embodiment

FIG. 9 is another example of blasting device for steel pipe inner surface according to the present invention, and shows an overall view of the blasting device for steel pipe inner surface.

This embodiment is hybrid type blasting device that combines high-pressure injection and negative-pressure suction. This embodiment operates in the same manner as the blasting device for steel pipe inner surface of the first embodiment by injecting a wiping material into the pipe 6 (steel pipe) for blasting with high-pressure fluid as the carrier fluid 20, and also suctioning air inside the steel pipe from the end portion of the steel pipe 6 so that the interior of the steel pipe reaches a negative pressure. Here, however, a tubular carrier fluid inflow unit 21 for injecting wiping material into the pipe 6 (steel pipe) for blasting with high-pressure fluid as a carrier fluid 20 includes a whistle-shaped air feed apparatus 26 for feeding the air 24 into a carrier fluid inflow unit 21. A swirl flow is formed along the inner wall of carrier fluid part 21 by the air 24 suctioned or injected in from this air feed apparatus 26. Here, a wiping material 5 injected in horizontally along with a carrier fluid 20 is injected horizontally into the carrier fluid inflow unit 21 after mixing with the carrier fluid in the wiping material/fluid mixing part 4.

Also, since pressure fluctuations in the carrier fluid are small from the beginning portion to the end portion across the entire pipe 6 (steel pipe) for blasting, the flow speed necessary to blast the inner surface of the steel pipe is sufficiently ensured in the pipe (steel pipe) 6 for blasting.

In this blasting device for steel pipe inner surface, the wiping material stored in the wiping material tank 3 is dropped into the high-pressure airflow 20 supplied from a compressor (not shown), and a wiping material/fluid mixing part 4 for mixing this wiping material with high-pressure air is installed at the beginning edge side of the pipe 6 (steel pipe) for blasting via the tubular carrier fluid inflow unit 21 and dummy pipe 22. The structure of this wiping material/fluid mixing part 4 is the same as the mixing part shown in FIG. 2. The high-pressure airflow 20 supplied through a nozzle 16 and a wiping material 5 supplied through a feeder 17 are mixed by a diffuser 18 and fed to the carrier fluid inflow unit 21.

A recovery tank 7 for receiving the used wiping material after wiping the internal surface of the pipe 6 and the negative-pressure air flow suspending and carrying the wiping material, and then separating the non-pulverized wiping material and the air, is installed at the end portion of the pipe (steel pipe) 6 for blasting. A discharging means 14 (The separated wiping material is returned here to the wiping material tank 3.) for discharging the wiping material separated by the recovery tank 7 is also installed. Also, a cyclone 8 and a dust collector 9 for separating the pulverized wiping material and wiped dust from the negative-pressure airflow, and a blower 10 for suctioning the used wiping material after the wiping and the negative pressure air flow suspending and carrying the wiping material from the pipe 6 for blasting via the cyclone 8 and dust collector 9 and discharging the air from which wiping material and wiping waste were removed, to the silencer 11, are connected to the recovery tank 7.

FIG. 10 shows an enlarged view (perspective view) of a tubular carrier fluid inflow unit in the blasting device for steel pipe inner surface according to the third embodiment.

The tubular carrier fluid inflow unit 21 includes a hole 19 in the center of edge face of the tubular carrier fluid inflow unit 21 for injecting a wiping material 5 horizontally into the carrier fluid inflow unit 21 along with the carrier fluid 20. The tubular carrier fluid inflow unit 21 includes a whistle-shaped air feed apparatus 26 for feeding the air 24 into the carrier fluid inflow unit 21. A swirl flow in which circumferential speed $V_\theta$ and radial speed $V_r$ are combined, is formed along the inner wall of the carrier fluid inflow unit by the air 24 suctioned or injected in from this air feed apparatus 26.

Here, the carrier fluid inflow unit 21 includes a shaft tube 22 coaxial with the tube of the carrier fluid inflow unit, and the carrier fluid 20 feeding the wiping material injected in horizontally from the hole 19 formed in the edge face of the tubular carrier fluid inflow unit 21 is injected into this shaft tube at a longitudinal speed $V_z$ and passed through the shaft tube at a longitudinal speed $V_z$.

A swirl flow formed by air 24 suctioned or injected in from an air feed apparatus 26 is therefore applied to the carrier fluid 20 for horizontally feeding the wiping material after passing through the shaft tube, and that speed is a combination of a longitudinal speed $V_z$, a circumferential speed $V_\theta$ and radial speed $V_r$.

In other words, after passing through the shaft tube, the wiping material fed by the carrier fluid 20 is blasted onto the pipe 6 (steel pipe) for blasting at a speed V shown in the following formula (2) the same as in the embodiment.

$$V=(V_z^2+V_\theta^2+V_r^2)^{1/2} \quad \text{Formula (2)}$$

Note that, the length of shaft tube 22 is also set to the same length as the carrier fluid inflow unit 21, but since the carrier fluid 20 for feeding the wiping material can be made blasted against the beginning portion of the steel pipe at a specified angle by adjusting the length of this shaft tube 22 and speed of carrier fluid 20, the length of shaft tube 22 may preferably be set so that that the wiping material fed by the carrier fluid 20 starts blasting the inner surface exactly from the beginning portion of the steel pipe.

A dummy pipe 23 is installed between the beginning portion of the steel pipe and the tubular carrier fluid inflow unit 21 provided horizontally with each other. Installing the dummy pipe 23 allows blasting the inner surface including a portion of dummy pipe 23 so that a wiping material can completely blast the pipe inner surface starting from the beginning portion of the steel pipe inner surface.

Fourth Embodiment

FIG. 11 is another example of the blasting device for steel pipe inner surface according to the present invention, and shows an overall view of the blasting device for steel pipe inner surface.

This embodiment is hybrid type blasting device that combines high-pressure injection and negative-pressure suction. This embodiment operates in the same manner as the blasting device for steel pipe inner surface of the first embodiment by injecting a wiping material 5 inside the pipe 6 (steel pipe) for blasting with high-pressure fluid as the carrier fluid 20, and also suctioning air inside the steel pipe from the end portion of the steel pipe 6 so that the interior of the steel pipe reaches a negative pressure. Here, however, a tubular carrier fluid inflow unit 21 for injecting wiping material into the pipe 6 (steel pipe) for blasting with high-pressure fluid as a carrier fluid 20 includes a whistle-shaped air feed apparatus 26 for feeding air 24 into a carrier fluid inflow unit 21. This whistle-shaped air feed apparatus 26 also supplies a wiping material stored in a wiping material tank 3 to the carrier fluid inflow unit 21. A swirl flow is formed along the inner wall of carrier fluid inflow unit 21 by the air 24 suctioned or injected in from this air feed apparatus 26. Here, the wiping material 5 injected in horizontally along with the carrier fluid 20 is injected horizontally into the carrier fluid inflow unit 21 after mixing with the carrier fluid in the wiping material/fluid mixing part 4.

Note that, since pressure fluctuations in the carrier fluid are small from the beginning portion to the end portion across the entire pipe 6 (steel pipe) for blasting, the flow speed necessary to blast the inner surface of the steel pipe is sufficiently ensured in the pipe (steel pipe) 6 for blasting.

In this blasting device for steel pipe inner surface, the wiping material stored in the wiping material tank 3 is dropped into the high-pressure airflow 20 supplied from a compressor (not shown), and a wiping material/fluid mixing part 4 for mixing this wiping material with high-pressure air is installed at the beginning edge side of the pipe 6 (steel pipe) for blasting via the tubular carrier fluid inflow unit 21 and dummy pipe 22. The structure of this wiping material/fluid mixing part 4 is the same as the mixing part shown in FIG. 2. The high-pressure airflow 20 supplied through a nozzle 16 and a wiping material 5 supplied through a feeder 17 are mixed by a diffuser 18 and fed to the carrier fluid inflow unit 21. In this blasting device for steel pipe inner surface, a wiping material 5 is also supplied from the whistle-shaped apparatus provided in the side face of the tubular carrier fluid inflow unit 21 to the carrier fluid inflow unit 21, and therefore a wiping material tank 3 capable of storing a wiping material 5 is installed above the air feed apparatus 26.

A recovery tank 7 for receiving the used wiping material after wiping the internal surface of the pipe 6 and the negative-pressure air flow suspending and carrying the wiping material, and then separating the non-pulverized wiping material and the air, is installed at the end portion of the pipe (steel pipe) 6 for blasting. A discharging means 14 (The separated wiping material is returned here to the wiping material tank 3.) for discharging the wiping material separated by the recovery tank 7 is also installed. Also, a cyclone 8 and a dust collector 9 for separating the pulverized wiping material and wiped dust from the negative-pressure airflow, and a blower 10 for suctioning the used wiping material after the wiping and the negative pressure air flow suspending and carrying the wiping material from the pipe 6 for blasting via the cyclone 8 and dust collector 9 and discharging the air from which wiping material and wiping waste were removed, to the silencer 11, are connected to the recovery tank 7.

FIG. 12 shows an enlarged view (perspective view) of a tubular carrier fluid inflow unit in the blasting device for steel pipe inner surface according to the fourth embodiment.

The tubular carrier fluid inflow unit 21 includes a hole 19 in the center of edge face of the tubular carrier fluid inflow unit 21 for injecting a wiping material 5 horizontally into the carrier fluid inflow unit 21 along with the carrier fluid 20. The tubular carrier fluid inflow unit 21 includes a whistle-shaped air feed apparatus 26 for feeding air 24 into the carrier fluid inflow unit 21 along with the wiping material 5. A swirl flow in which circumferential speed $V_\theta$ and radial speed $V_r$ are combined, is formed along the inner wall of the carrier fluid inflow unit by the air 24 suctioned or injected in from this air feed apparatus 26.

Here, the carrier fluid inflow unit 21 includes a shaft tube 22 coaxial with the tube of the carrier fluid inflow unit, and the carrier fluid 20 feeding the wiping material injected in horizontally from the hole 19 formed in the edge face of the tubular carrier fluid inflow unit 21 is injected into this shaft tube at a longitudinal speed $V_z$ and passed through the shaft tube at a longitudinal speed $V_z$. Further, the air 24 supplied from the whistle-shaped air feed apparatus 26 installed in the carrier fluid inflow unit 21 feeds a wiping material 5 supplied from the whistle-shaped air feed apparatus 26, and also forms a swirl flow at a swirl speed $V_\theta$ swirling along the inner walls of tubular carrier fluid inflow unit 21 on the outer circumference of shaft tube 22.

A swirl flow formed by the air 24 carrying the wiping material 5 supplied from the air feed apparatus 26 is therefore applied to the carrier fluid 20 for horizontally feeding the wiping material after passing through the shaft tube, and that speed is a combination of a longitudinal speed $V_z$, a circumferential speed $V_\theta$ and radial speed $V_r$.

In other words, after passing through the shaft tube, the wiping material fed by the carrier fluid 20 is blasted onto the pipe 6 (steel pipe) for blasting at a speed V shown in the following formula (2) the same as in the second embodiment.

$$V=(V_z^2+V_\theta^2+V_r^2)^{1/2} \quad \text{Formula (2)}$$

Note that, the length of shaft tube 22 is also set to the same length as the carrier fluid inflow unit 21, but since the carrier fluid 20 for feeding the wiping material can be made blasted against the beginning portion of the steel pipe at a specified angle by adjusting the length of this shaft tube 22 and speed of carrier fluid 20, the length of shaft tube 22 may preferably be set so that that the wiping material fed by the carrier fluid 20 starts blasting the inner surface exactly from the beginning portion of the steel pipe.

A dummy pipe 23 is installed between the beginning portion of the steel pipe and the tubular carrier fluid inflow unit 21 provided horizontally with each other. Installing the dummy pipe 23 allows blasting the inner surface including a portion of dummy pipe 23 so that a wiping material can completely blast the pipe inner surface starting from the beginning portion of the steel pipe inner surface.

FIG. 13 shows for purposes of comparison an enlarged view (perspective view) of a tubular carrier fluid inflow unit of the negative-pressure suction blasting device (shown as FIG. 1 in Patent document 1) in FIG. 3.

The tubular carrier fluid inflow unit 21 has a whistle-shaped air feed apparatus 26 for feeding the air 24 into the carrier fluid inflow unit 21 along with the wiping material 5. A swirl flow is formed along the inner wall of the carrier fluid inflow unit at a circumferential speed $V_\theta$ by the air 24 suctioned or injected in from this air feed apparatus 26. Further, since the swirl flow is pulled longitudinally by the negative-pressure airflow, a longitudinal speed $V_z$ is generated in addition to a circumferential speed $V_\theta$, so that the swirl flow speed is a combination of the longitudinal speed $V_z$ and circumferential speed $V_\theta$.

In other words, a wiping material fed by the negative-pressure air 24 is blasted onto the pipe 6 (steel pipe) for blasting at a speed V shown in the following formula (3).

$$V=(V_z^2+V_\theta^2)^{1/2} \quad \text{Formula (3)}$$

Fifth Embodiment

A test utilizing an experimental apparatus having a structure of the blasting device for steel pipe internal surface shown in the third embodiment was performed in order to understand how wiping material behaves in the pipe (steel pipe) for blasting when wiping material is fed by the carrier fluid.

FIG. 14 shows the experimental apparatus for understanding the behavior of wiping material in the pipe for blasting (a steel pipe) when using the blasting device for steel pipe inner surface of the third embodiment. A transparent pipe made of polycarbonate was used as the material for the blasting device for pipe inner surface. Silica sand flowing in this transparent pipe made of polycarbonate was photographed at several points in the longitudinal direction of a blast pipe by a high speed camera, and the speed and the direction of the silica sand were analyzed at each position.

A high-pressure airflow 20 from a compressor (not shown) at air flow rate $Q_N$ was supplied to a wiping material/fluid mixing part 4 (inner diameter: $D_r$). Then, silica sands serving as the wiping material 5 were supplied from a wiping material tank 3, and after mixing both, the mixture was injected into the carrier fluid inflow unit 21 through a shaft tube 22. Separately, the air 24 was suctioned or injected into the carrier fluid inflow unit 21 from a whistle-shaped air feed apparatus 26 installed at the carrier fluid inflow unit 21 by a negative pressure with an air flow rate $Q_A$, to form a swirl flow along the inner wall of carrier fluid inflow unit 21. The experimental conditions are shown in Table 1 (invention examples 1 and 2).

For purposes of comparison, the behavior of wiping material in a pipe for blasting (a steel pipe) when the wiping material was fed by the carrier fluid was found by utilizing a comparative experimental apparatus with the structure of the negative-pressure suction blasting device shown in FIG. 3 and FIG. 13.

FIG. 15 is an experimental apparatus for making the comparison. This experimental apparatus was utilized to understand the behavior of a wiping material in the pipe for blasting (a steel pipe) in negative-pressure suction blasting device for pipe inner surface. A transparent pipe made of polycarbonate was used as a material for blasting. Silica sands flowing in this transparent polycarbonate pipe was photographed at several points in the longitudinal direction of the blast pipe by high speed camera, and the speed and the direction of silica sand were analyzed at each position.

While silica sands serving as the wiping material 5 were supplied from a wiping material tank 3 to a whistle-shaped air feed apparatus 26 equipped at the carrier fluid inflow unit 21, air 24 was suctioned to the interior of a carrier fluid inflow unit 21 from a whistle-shaped air feed apparatus 26 installed at the carrier fluid inflow unit 21 by a negative pressure with an air flow rate $Q_A$, to thereby form a swirl flow along the inner wall of carrier fluid inflow unit 21. Additionally, the experimental conditions are shown in Table 1 (Comparative examples 1 and 2).

TABLE 1

| Mark | Nozzle shape | Negative-pressure suction air: QA (Cross-section average flow speed) | High-pressure air flow rate (Carrier fluid) |
|---|---|---|---|
| ◇ | invention example 1 | 30 Nm/s | 6 to 9% of negative-pressure suction air |
| ○ | invention example 2 | 40 Nm/s | |
| ◆ | Comparative example 1 | 30 Nm/s | None |
| ● | Comparative example 2 | 40 Nm/s | |

The different types of moving speeds (combined speed V, longitudinal speed $V_z$, circumferential speed $V_\theta$) of silica sand serving as the wiping material and incident angle $\alpha$ of the silica sand are each shown in FIGS. 16 to 19.

Comparing the invention examples 1 and 2 with the comparative examples 1 and 2, shows no difference in the combined speed V in the beginning portion of pipe for blasting, but examples 1 and 2 of the invention exceed the comparative examples 1 and 2 from the midpoint and onward of the pipe for blasting (FIG. 16). The longitudinal speed $V_z$ of the invention examples 1 and 2 exceeds the comparative examples 1 and 2 in all cases from the beginning portion to the end portion of the pipe for blasting (FIG. 17).

In contrast, the swirling angle $\theta$ (angle between speed components $V_\theta$ and $V_z$ of wiping material) of comparative examples 1 and 2 greatly exceeds the invention examples 1 and 2 in the beginning portion of a pipe for blasting, and also exceeds the invention examples 1 and 2 in the end portion of a pipe for blasting (FIG. 18). However, when the swirling angle $\theta$ is too large such as in comparative examples 1 and 2, then unwanted stripe patterns might occur in the inner surface of a pipe for blasting, and when there is too large of a difference in the swirling angle θ between the beginning and end portions of the pipe for blasting such as in comparative examples 1 and 2, then the problem arises that different blast effects occur longitudinally along the inner surface of the pipe for blasting.

The incident angle α of wiping material in comparative examples 1 and 2 greatly exceeds the incident angle α in the invention examples 1 and 2 in the beginning portion of a pipe for blasting, and also exceeds the invention examples 1 and 2 in the end section of a pipe (FIG. 19). However, when the incident angle α of wiping material is too large such as in the comparative examples 1 and 2, then blast effects might not appear on the inner surface of the pipe. When there is too large a difference in the incident angle α of wiping material between the beginning and end portions of the pipe for blasting, then the problem arises that different blast effects occur longitudinally along the inner surface of the pipe for blasting. In contrast however, the incident angle α of wiping material in the invention examples 1 and 2 is within the most suitable angle range of 10 to 30°.

Additionally, the reason why there is no difference in the combined speed V in the beginning portion of a pipe for blasting is thought to be that the longitudinal speed $V_z$ in the invention examples 1 and 2 is large, and the circumferential speed $V_\theta$ is large in the comparative examples 1 and 2.

The reason why 10 to 30° is the most suitable angle range for the incident angle α of wiping material is as follows.

FIG. 20 is graph showing the interrelation of the collision angle and amount of abrasion (by Arundel et. al) reprinted from FIG. 3.13 in the text "Measuring Abrasion of airborne particles" edited by Hashimoto Kenji, p. 56, NTS, (1989). The description for this graph shows that the collision-abrasion speed of metal particles against steel material generally has a peak in a range of 10 to 30° at incident angle α, and that the incident angle α is preferably 10 to 30°.

Sixth Embodiment

The blasting device for steel pipe inner surface of the third embodiment (see FIGS. 9 and 10) was applied to an actual device for blasting steel pipe inner surface. A steel pipe (outer diameter: 114.3 mm) made of 13% Cr martensite type stainless steel (API (American Petroleum Institute) specification) was descaled using silica sand as the wiping material. The experimental conditions were as follows.

Pipe cross-sectional average flow speed=90 to 110 meters per second (differs depending on longitudinal positions)

Carrier fluid injection flow rate=3% of suction flow rate

Inner diameter of shaft tube=about ¼ of inner diameter of carrier fluid inflow unit 21

Outer diameter of shaft tube=114.3 mm

Wall thickness of shaft tube=6.88 mm

Length of shaft tube=12.5 m

Input position of powder=Same longitudinal position as the air inflow endpoint

The negative-pressure suction blasting device shown in FIG. 3 and FIG. 13 was applied to actual device for blasting steel pipe inner surface. The steel pipe (outer diameter: 114.3 mm) made of 13% Cr martensite type stainless steel (API (American Petroleum Institute) specification) was descaled (Comparative example 3) using silica sand as a wiping material. The experimental conditions were as follows.

Pipe cross-sectional average flow speed=90 to 110 meters per second (differs depending on longitudinal positions)

Powder input position=drop input from air suction apparatus 26

Table 2 shows the experimental results for comparative example 3 and the sixth embodiment. In these results, the state of the inner surface in the pipe end portion after the wiping with predetermined times was observed visually. Here, "O" denotes that descaling was completed, and "x" denotes descaling was incomplete.

TABLE 2

| | 6th Embodiment | Comparative example 3 |
|---|---|---|
| 12.4 min (operation condition) | ○ | ○ |
| 11.2 min (10% shortened) | ○ | x |
| 9.9 min (20% shortened) | x | x |

In the sixth embodiment using the blasting device for steel pipe inner surface of the present invention, descaling was completed even when the operation time was shortened by 10%. In the comparative example 3 using negative-pressure suction blasting device however, descaling was not completed when the operation time was shortened by 10%. In other words, results showed that the blasting device for steel pipe inner surface of this invention had higher wiping performance than the negative-pressure suction blasting equipment.

INDUSTRIAL APPLICABILITY

The present invention provides blasting device for steel pipe inner surface with improved blast performance as well as the capability to sufficiently blast the inner surface of steel pipe from the beginning portion to the end portion; as well as a blasting method for steel pipe inner surface; and a method for producing a steel pipe with excellent inner surface texture.

BRIEF DESCRIPTION OF THE DRAWINGS

FIG. 1 is high-pressure injection blasting device shown in Patent document 1 as FIG. 12;

FIG. 2 is a schematic view showing the state when wiping material 5 carried by high-pressure airflow 20 as the carrier blasts the steel pipe inner surface at incident angle α;

FIG. 3 is a drawing of the negative-pressure suction blasting device shown as FIG. 1 in Patent document 1;

FIG. 4 is a schematic view showing the state when wiping material 5 carried by the negative-pressure airflow 15 as the carrier blasts the inner surface of a steel pipe 6 at incident angle α;

FIG. 5 is an example of blasting device for steel pipe inner surface according to the present invention, and shows an overall view of the blasting device for steel pipe inner surface;

FIG. 6 shows an enlarged view (perspective view) of the tubular carrier fluid inflow unit in the blasting device for steel pipe inner surface shown in FIG. 5;

FIG. 7 is another example of the blasting device for steel pipe inner surface according to present invention, and shows an overall view of the blasting device for steel pipe inner surface;

FIG. 8 shows an enlarged view (perspective view) of a tubular carrier fluid inflow unit in the blasting device for steel pipe inner surface of FIG. 7;

FIG. 9 is another example of the blasting device for steel pipe inner surface of the present invention, and shows an overall view of the blasting device for steel pipe inner surface;

FIG. 10 shows an enlarged view (perspective view) of a tubular carrier fluid inflow unit in the blasting device for steel pipe inner surface in FIG. 9;

FIG. 11 is another example of the blasting device for steel pipe inner surface of the present invention, and shows an overall view of the blasting device for steel pipe inner surface;

FIG. 12 shows an enlarged view (perspective view) of the tubular carrier fluid inflow unit in the blasting device for steel pipe inner surface in FIG. 11;

FIG. 13 shows an enlarged view (perspective view) of a tubular carrier fluid inflow unit for the negative-pressure suction blasting device in FIG. 3 shown for comparison;

FIG. 14 shows an experimental apparatus for understanding the behavior of wiping material in a pipe for blasting (steel pipe) when using the blasting device for steel pipe inner surface shown in FIG. 9 and FIG. 10;

FIG. 15 shows an experimental apparatus for understanding the behavior of the wiping material in a pipe for blasting (steel pipe) in the negative-pressure suction blasting device in FIG. 3;

FIG. 16 shows the moving speed (combined speed V) of silica sand utilized as the wiping material;

FIG. 17 shows the moving speed (longitudinal speed $V_z$) of silica sand utilized as the wiping material;

FIG. 18 shows the swirl angle θ of the silica sand utilized as wiping material;

FIG. 19 shows the incident angle α of the silica sand utilized as wiping material;

FIG. 20 is a diagram showing the relation between metal powder and the metal surface and the collision angle and amount of abrasion.

DESCRIPTION OF REFERENCE NUMERALS

1: Compressor, 2: Air drier, 3: Wiping material tank, 4: Wiping material/fluid mixing part, 5: Wiping material, 6: Pipe for blasting (steel pipe), 7: Recovery tank of gravity drop type, 8: Cyclone, 9: Dust collector with filter, 10: Suction blower, 11: Silencer, 13: Wiping material-air supply unit, 14: Discharging means, 15: Negative-pressure airflow (carrier fluid), 16: Nozzle, 17: Feeder, 18: Diffuser, 19: Hole, 20: High-pressure airflow (carrier fluid), 21: Carrier fluid inflow unit, 22: Shaft tube, 23: Dummy pipe, 24: Air, 25: Air inflow port, 26: Air feed apparatus α: Incident angle of wiping material θ: Angle formed by speed components $V_\theta$ and $V_z$ of wiping material $D_r$: Inner diameter of wiping material/fluid mixing part $Q_A$: Air flow rate $Q_N$: Air flow rate $V_z$: Longitudinal speed $V_\theta$: Circumferential speed $V_r$: Radial speed

The invention claimed is:

1. A hybrid type blasting device for steel pipe inner surface that combines high-pressure injection and negative-pressure suction, comprising:

a compressor for supplying high pressure air, a wiping material or a polishing material tank for dropping the wiping material or the polishing material into the high pressure air, a tubular carrier fluid inflow unit connected to one end of a steel pipe installed horizontally, and a suction blower for suctioning the air inside the steel pipe from the other end of the steel pipe, wherein the compressor and the wiping material or polishing material tank are arranged upstream from an edge face of the tubular carrier flow inflow unit such that the wiping material or the polishing material is injected into the tubular carrier fluid inflow unit horizontally along with the high pressure air from a hole formed in the edge face of the tubular carrier fluid inflow unit.

2. A hybrid type blasting device for steel pipe inner surface that combines high-pressure injection and negative-pressure suction, comprising:

a compressor for supplying high pressure air, a wiping material or a polishing material tank for dropping the wiping material or the polishing material into the high pressure air, a tubular carrier fluid inflow unit connected to one end of a steel pipe installed horizontally, and a suction blower for suctioning the air inside the steel pipe from the other end of the steel pipe, wherein the compressor and the wiping material or polishing material tank are arranged upstream from an edge face of the tubular carrier flow inflow unit such that the wiping material or the polishing material is injected into the tubular carrier fluid inflow unit horizontally along with the high pressure air from a hole formed in a center of the edge face of the tubular carrier fluid inflow unit.

3. The blasting device for steel pipe inner surface according to claim 1, wherein a dummy pipe connects between the one end of the steel pipe installed horizontally and the tubular carrier fluid inflow unit.

4. The blasting device for steel pipe inner surface according to claim 1, wherein a shaft tube is installed concentrically with a tube of the carrier fluid inflow unit inside the tubular carrier fluid inflow unit.

5. The blasting device for steel pipe inner surface according to claim 1, wherein at least one air inflow port for feeding air into the carrier fluid inflow unit is formed in a tube portion of the tubular carrier fluid inflow unit.

6. The blasting device for steel pipe inner surface according to claim 5, wherein a whistle-shaped air introducing apparatus or an air injecting apparatus is installed in at least one air inflow port.

7. The blasting device for steel pipe inner surface according to claim 5, wherein in addition to injecting the wiping material or polishing material horizontally into the carrier fluid inflow unit along with the carrier fluid, the wiping material or polishing material is also supplied from the air inflow port of the carrier fluid inflow unit.

8. The blasting device for steel pipe inner surface according to claim 5, wherein air fed from the air inflow port forms a swirl flow along an inner wall of the tubular carrier fluid inflow unit.

9. The blasting device for steel pipe inner surface according to claim 1, wherein the steel pipe is a martensite type stainless steel pipe.

10. A blasting method for a steel pipe inner surface utilizing the blasting device for steel pipe inner surface according to claim 1.

11. A production method for a steel pipe with excellent inner surface texture, wherein the steel pipe inner surface is wiped or polished utilizing the blasting device for steel pipe inner surface according to claim 1.

* * * * *